US009156156B2

(12) United States Patent
Wang

(10) Patent No.: US 9,156,156 B2
(45) Date of Patent: Oct. 13, 2015

(54) TOOL BOX WITH STORAGE MEMBERS

(71) Applicant: Eupin Wang, New Taipei (TW)

(72) Inventor: Eupin Wang, New Taipei (TW)

( * ) Notice: Subject to any disclaimer, the term of this patent is extended or adjusted under 35 U.S.C. 154(b) by 0 days.

(21) Appl. No.: 14/205,094

(22) Filed: Mar. 11, 2014

(65) Prior Publication Data

US 2015/0258676 A1 Sep. 17, 2015

(51) Int. Cl.

| | |
|---|---|
| ***B65D 85/20*** | (2006.01) |
| ***B25H 3/02*** | (2006.01) |
| ***B65D 43/16*** | (2006.01) |
| ***B65D 21/08*** | (2006.01) |

(52) U.S. Cl.

CPC ..... *B25H 3/021* (2013.01); *B65D 21/083* (2013.01); *B65D 43/16* (2013.01)

(58) Field of Classification Search

CPC ..... B25H 3/003; B25H 3/023; B25H 3/025; B25H 3/021; Y10S 312/902; B65D 85/20; A47F 7/0028; A47F 5/02

USPC ..... 206/377, 349, 376, 372, 373, 378, 379; 211/70.6, 170, 163, 69

See application file for complete search history.

(56) References Cited

U.S. PATENT DOCUMENTS

| | | | | |
|---|---|---|---|---|
| 6,405,864 | B1 * | 6/2002 | Streich et al. | 206/373 |
| 6,755,302 | B1 * | 6/2004 | Streich et al. | 206/373 |
| RE38,905 | E * | 12/2005 | Wei | 206/373 |
| 7,322,470 | B2 * | 1/2008 | Brunson | 206/372 |
| 7,900,771 | B1 * | 3/2011 | Meng | 206/379 |
| 7,931,143 | B1 * | 4/2011 | Lin | 206/373 |
| 8,651,348 | B2 * | 2/2014 | Meng | 224/245 |
| 2009/0266730 | A1 * | 10/2009 | Lin | 206/372 |
| 2011/0031145 | A1 * | 2/2011 | Larson et al. | 206/372 |

* cited by examiner

*Primary Examiner* — Steven A. Reynolds

(74) *Attorney, Agent, or Firm* — Patent Office of Bang Shia

(57) ABSTRACT

A tool box includes two pivoted halves, at least one of which has a chamber with a bottom and two opposite walls. Plural positioning units are disposed on the walls and each include a straight guide groove, a guide gap and a positioning cavity at two ends of the straight guide groove, a first pivot cavity located closer to the bottom than the positioning cavity, a second pivot cavity between the positioning cavity and a positioning cavity of a neighboring positioning unit, and an arc-shaped guide groove covering the first and second pivot cavities. The arc-shaped guide groove has two arc-shaped ends to connect the first pivot cavity and a straight guide groove of the neighboring positioning unit. The storage member has pivots pivotally disposed in the first pivot cavity and the positioning cavity, or in the first or second pivot cavity of the neighboring positioning unit.

3 Claims, 7 Drawing Sheets

TOOL BOX WITH STORAGE MEMBERS

BACKGROUND OF THE INVENTION

1. Field of the Invention

The present invention relates to a tool box, and more particularly to a tool box with storage members to store tools, such as screwdriver head, and sockets.

2. Description of the Prior Art

Tool boxes used for storage of tools, such as screwdriver head, socket, are normally provided with a cushion or a storage member, and the screwdriver heads or sockets can be inserted in the cushion or storage member for easy recognition or pick up by the user. However, the screwdriver heads or sockets can not be pivoted in the tool boxes for exhibition purpose.

The present invention has arisen to mitigate and/or obviate the afore-described disadvantages.

SUMMARY OF THE INVENTION

The primary objective of the present invention is to provide a tool box which storage members, wherein the storage members are allowed to pivot and then fixed in the tool box, so as to improve the functionality of the tool box.

To achieve the above objective, a tool box with storage members in accordance with the present invention comprises: two halves, a plurality of positioning units, and at least one storage member. The two halves are pivoted to each other to form the tool box and capable of being opened and closed with respect to each other, at least one of the two halves is formed with a chamber which includes a bottom and two opposite walls. The positioning units are disposed on the two walls, and each include a straight guide groove which is formed in the walls and located in a first direction, a guide gap which is formed at one end of the straight guide groove and located in the first direction, a positioning cavity which is formed at another end of the straight guide groove, disposed in the first direction and located closer to the bottom than the guide gap, a first pivot cavity which is formed in the walls, disposed in the first direction and located closer to the bottom than the positioning cavity, a second pivot cavity which is formed in the walls and located between the positioning cavity and a positioning cavity of a neighboring positioning unit, and an arc-shaped guide groove which is formed in the walls and covers the first and second pivot cavities, the arc-shaped guide groove including a first arc-shaped end at which the first pivot cavity is located, and a second arc-shaped end which is in communication with a straight guide groove of the neighboring positioning unit. The storage member is removably and pivotally disposed in the chamber, and includes at least one tool-insertion cavity and two lateral surfaces located toward the two walls. Each of the lateral surfaces includes a first pivot which is pivotally disposed in the first pivot cavity, and a second pivot which is pivotally disposed in the positioning cavity, or in the first pivot cavity of the neighboring positioning unit, or in the second pivot cavity of the neighboring positioning unit.

DETAILED DESCRIPTION OF THE PREFERRED EMBODIMENTS

Figure 1:
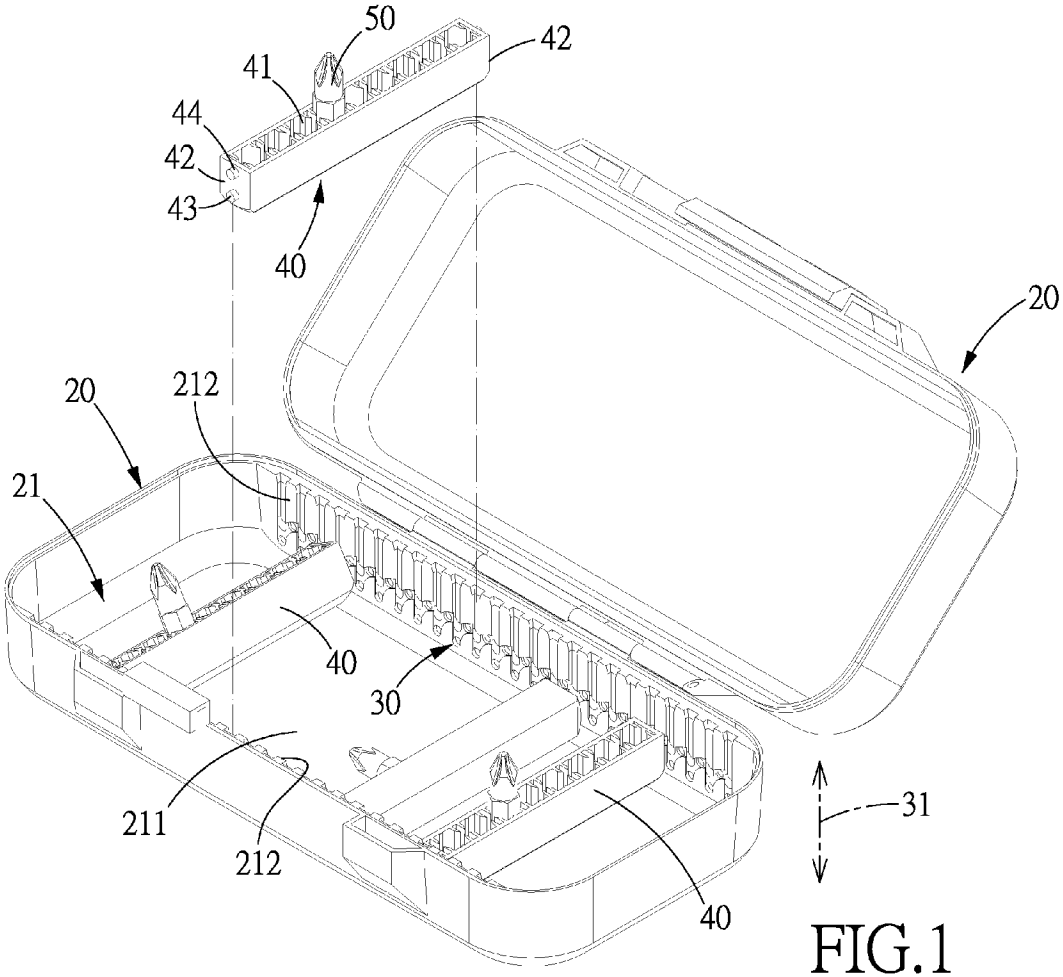
FIG. 1 is a perspective view of a tool box in accordance with a first embodiment of the present invention.

The present invention will be clearer from the following description when viewed together with the accompanying drawings, which show, for purpose of illustrations only, the preferred embodiment in accordance with the present invention.

Referring to FIGS. 1-4, a tool box in accordance with the present invention is shown and comprises: two halves 20, a plurality of positioning units 30, and five storage members 40.

The two halves 20 are pivoted to each other to form the tool box, and capable of being opened and closed with respect to each other. At least one of the two halves 20 is formed with a chamber 21 which includes a bottom 211 and two opposite walls 212. Since the two halves 20 of the tool box are of conventional structures, further description would be omitted here.

The positioning units 30 are disposed on the two walls 212, and each include a straight guide groove 32 which is formed in the walls 212 and located in a first direction 31, a guide gap 321 which is formed at one end of the straight guide groove 32 and located in the first direction 31, a positioning cavity 322 which is formed at another end of the straight guide groove 32, disposed in the first direction 31 and located closer to the bottom 211 than the guide gap 321, a first pivot cavity 33 which is formed in the walls 212, disposed in the first direction 31 and located closer to the bottom 211 than the positioning cavity 322, a second pivot cavity 34 which is formed in the walls 212 and located between the positioning cavity 322 and a positioning cavity 322 of a neighboring positioning unit 30 (at the right side), and an arc-shaped guide groove 35 which is formed in the walls 212 and covers the first and second pivot cavities 33, 34. The arc-shaped guide groove 35 includes a first arc-shaped end 351 where the first pivot cavity 33 is located, and a second arc-shaped end 352 which is in communication with a straight guide groove 32 of the neighboring positioning unit 30 (at the right side). In this embodiment, the positioning cavity 322 of the straight guide groove 32 is provided with an inclined guide surface 323 which is located within the arc-shaped guide groove 35. The distances from the first pivot cavity 33 to the positioning cavity 322, the first pivot cavity 33 of a neighboring positioning unit 30 (at the left side), and the second pivot cavity 34 of the neighboring positioning unit 30 at the left side, are the same.

The four storage members 40 are identical structures pivotally and removably disposed in the chamber 21, and each include at least one tool-insertion cavity 41 and two lateral surfaces 42 located toward the two walls 212. Each of the lateral surface 42 includes a first pivot 43 which is pivotally disposed in the first pivot cavity 33, and a second pivot 44 which is pivotally disposed in the positioning cavity 322, or in the first pivot cavity 33 of the neighboring positioning unit 30

(at the left side), or in the second pivot cavity 34 of the neighboring positioning unit 30 at the left side.

What mentioned above are the structures of the present invention, for a better understanding of the invention, its operating advantages and the specific objects attained by its uses, reference should be had to the following descriptive matter.

Each of the storage members 40 can be pivoted and fixed in the following three ways.

Figure 4:
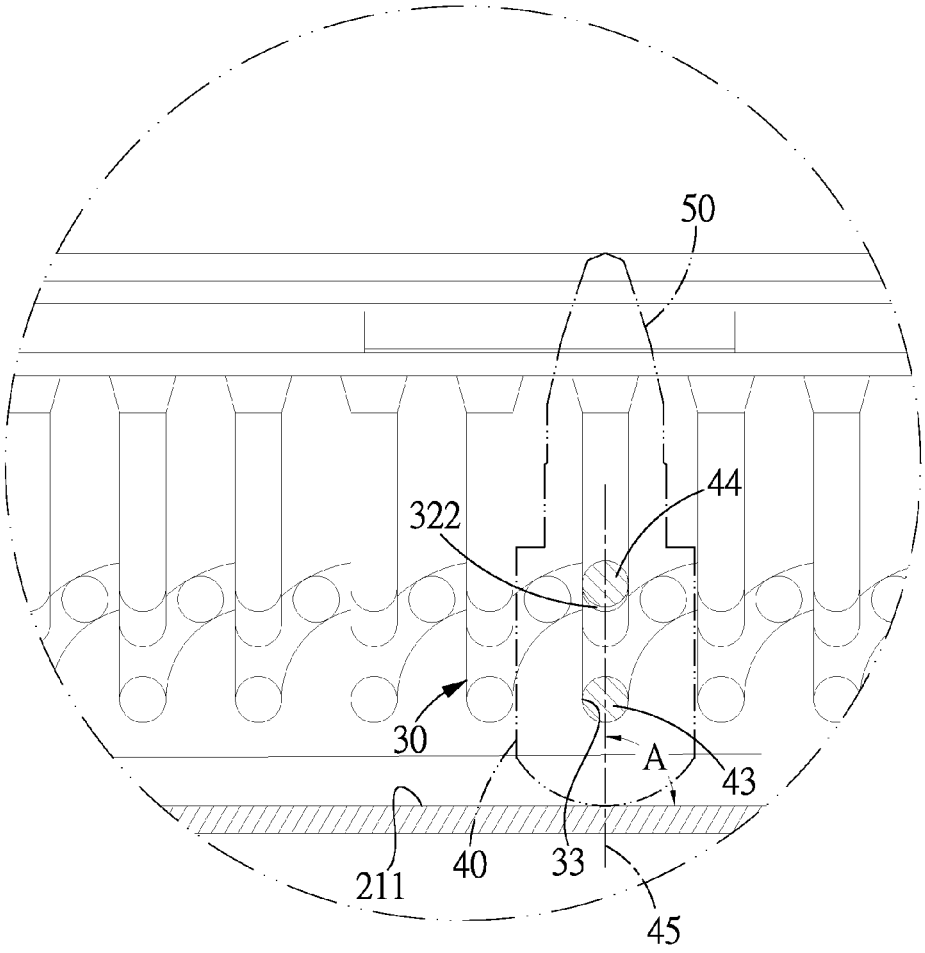
FIG. 4 is an enlarged view of a part of the tool box in accordance with the present invention, wherein the storage member is fixed in a vertical manner.

First, the storage member 40 (only one storage member 40 described for easy explanation) is pivoted and fixed in the vertical direction. As shown in FIGS. 1 and 4, firstly, the first pivot 43 of the storage member 40 is pivotally disposed in the first pivot cavity 33 of the positioning unit 30, and the second pivot 44 is positioned in the positioning cavity 322 of the same positioning unit 30. At this moment, the tool-insertion cavity of the storage member 40 vertically opens upward (as shown in the figures, the connecting line 45 between the first and second pivots 43, 44 defines an angle A which is 90 degrees with respect to the bottom 211), so that the screwdriver head 50 inserted in the too-insertion cavity is held in a vertical manner for easy recognition and pick up by the user.

Figure 5:
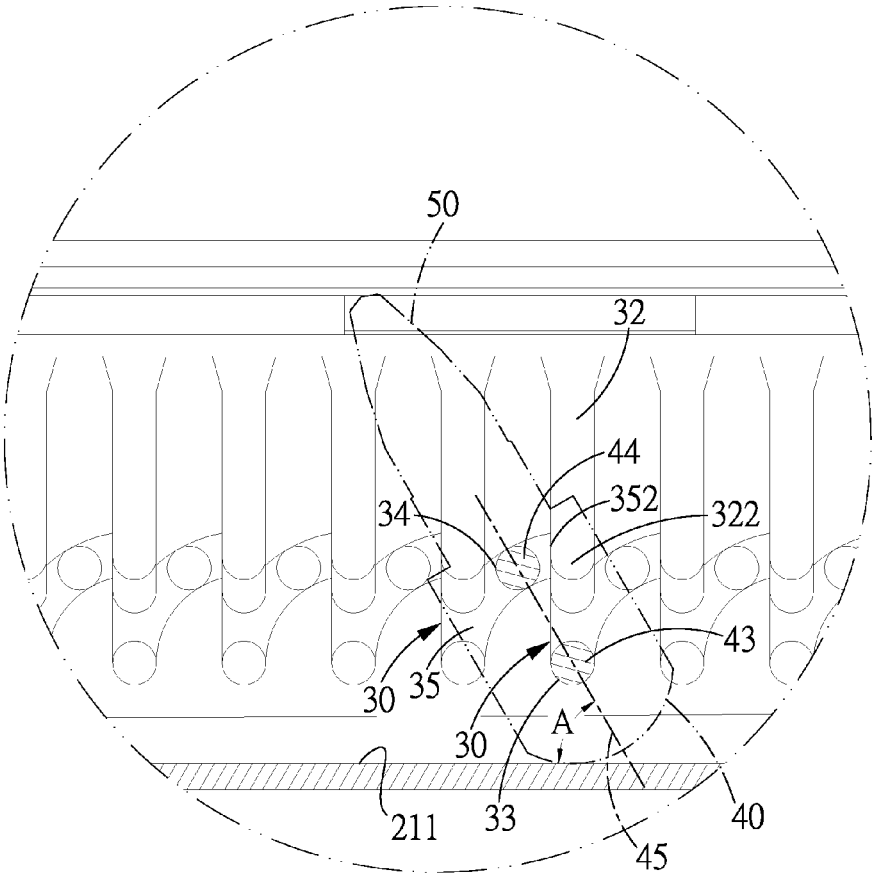
FIG. 5 is an enlarged view of a part of the tool box in accordance with the present invention, wherein the storage member pivots an angle and fixed in an inclined manner.

Second, the storage member 40 is fixed after pivoting an angle. As shown in FIGS. 1, 4 and 5, the storage member 40 is fixed in the vertical direction in the first manner, and the first pivot 43 of the storage member 40 is still pivotally disposed in the first pivot cavity 33 of the positioning unit 30. Then the storage member 40 pivots around the first pivot 43 to make the second pivot 44 rotate counterclockwise from the positioning cavity 322 toward a neighboring positioning unit 30 at the left side, so that the second pivot 44 will slide through the second arc-shaped end 352 of the neighboring positioning unit 30 at the left side into the arc-shaped guide groove 35, and then guided by the arc-shaped guide groove 35 into the second pivot cavity 34 of the neighboring positioning unit 30 at the left side. At this moment, the tool-insertion cavity of the storage member 40 has been pivoted an angle and fixed in an inclined position (as shown in the figures, the connecting line 45 between the first and second pivots 43, 44 defines an angle A which is 30 degrees with respect to the bottom 211), so that the screwdriver head 50 inserted in the too-insertion cavity is held in an inclined position, which is also for easy recognition and pick up by the user.

Figure 6:
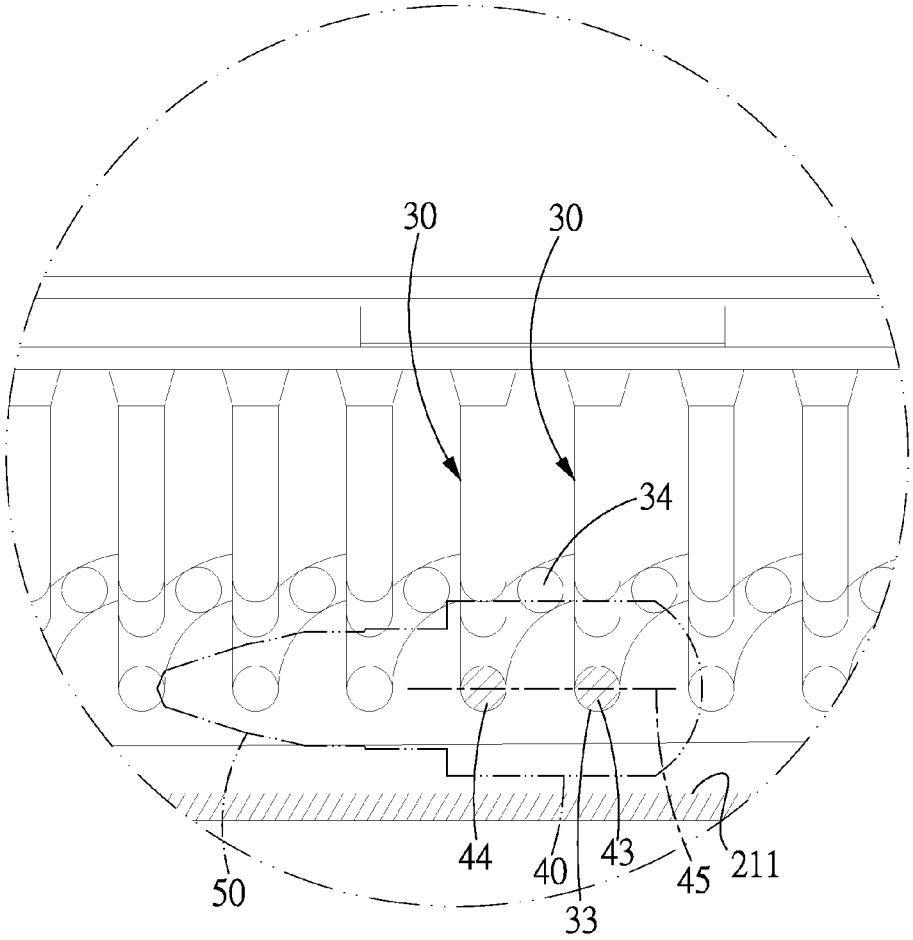
FIG. 6 is an enlarged view of a part of the tool box in accordance with the present invention, wherein the storage member pivots an angle and is fixed in a horizontal manner.

Third, the storage member 40 is fixed in a horizontal position. As shown in FIGS. 1, 5 and 6, the storage member 40 is in an inclined position, and the first pivot 43 of the storage member 40 is still pivotally disposed in the first pivot cavity 33 of the positioning unit 30. Then the storage member 40 pivots around the first pivot 43 to make the second pivot 44 rotate counterclockwise from the second pivot cavity 34 of the neighboring positioning unit 30 at the left side, while rotating, the second pivot 44 is guided by the arc-shaped guide groove 35 to move into the first pivot cavity 33 of the neighboring positioning unit 30 at the left side. At this moment, the tool-insertion cavity of the storage member 40 is fixed in a horizontal position (as shown in the figures, the connecting line 45 between the first and second pivots 43, 44 is in parallel to the bottom 211), so that the screwdriver head 50 inserted in the too-insertion cavity is also held in a horizontal position for easy recognition and pick up by the user.

As described above, the storage member 40 of the present invention can be pivoted and fixed in three manners with respect to the tool box, namely, the vertical manner, inclined manner, and horizontal positions, so as to improve the functionality of the tool box.

Figure 2:
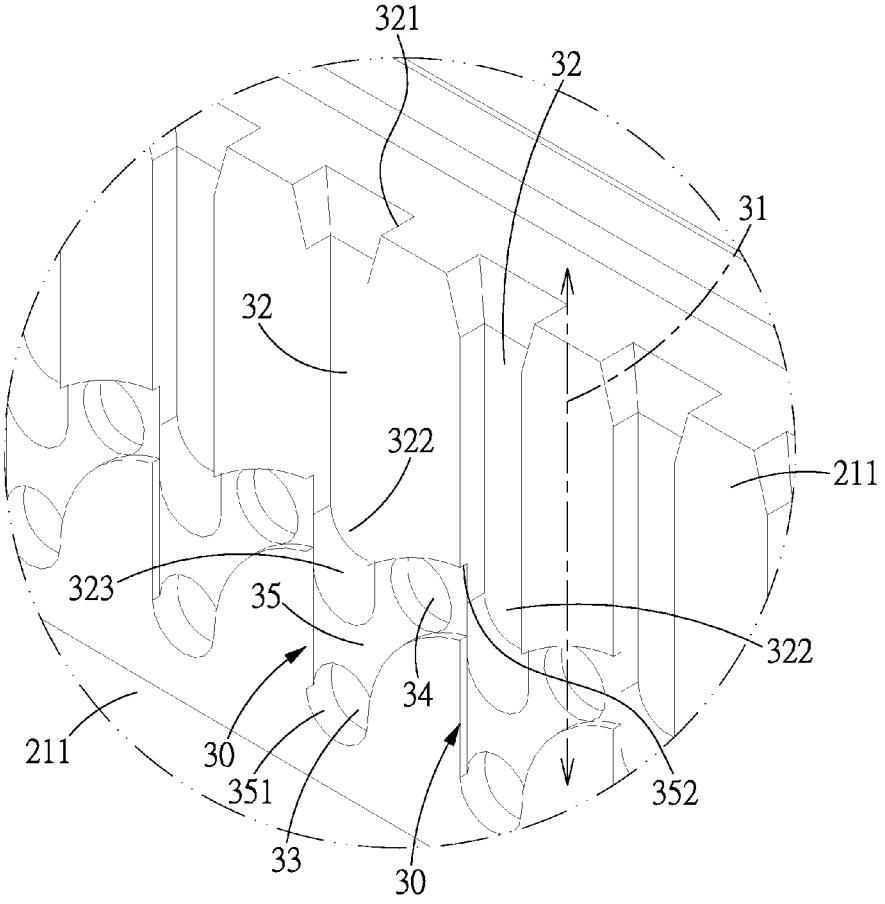
FIG. 2 is an enlarged view of a part of FIG. 1.
Figure 3:
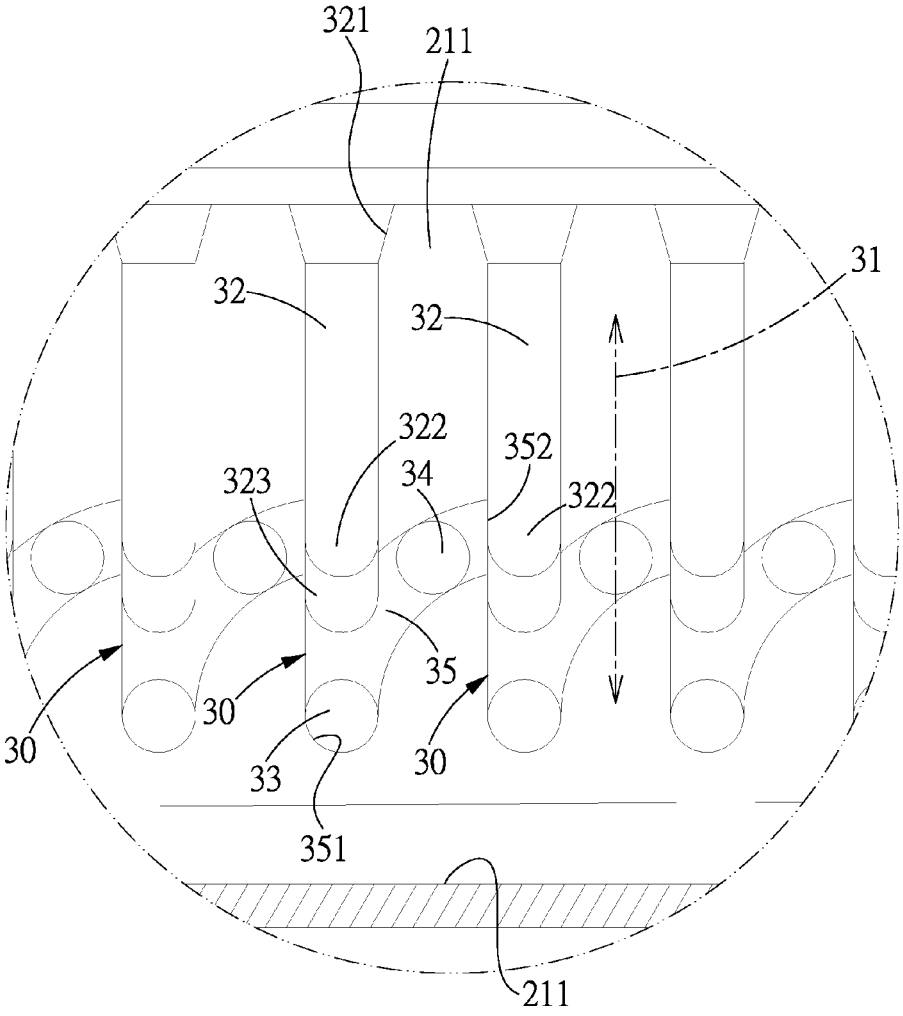
FIG. 3 is another enlarged view of a part of FIG. 1.

It is to be noted that, as shown in FIGS. 1, 2 and 4, the positioning unit 30 of the present invention is provided with the straight guide groove 32 formed in the walls 212 along the first direction 31, and the straight guide groove 32 is formed with the guide gap 321. Therefore, the first and second pivots 43, 44 of the storage member 40 can be guided into the straight guide groove 32 via the guide gap 321, which makes the storage member easy to assemble. Besides, the positioning cavity 322 of the straight guide groove 32 has the inclined guide surface 323 which is located in the arc-shaped guide groove 35, and the first pivot cavity 33 is formed in the first arc-shaped end 351 of the arc-shaped guide groove 35, so that the first pivot 43 of the storage member 40 can be guided by the inclined guide surface 323 to smoothly move into the first pivot cavity 33, making the storage member 40 easy to fit or remove.

Figure 7:
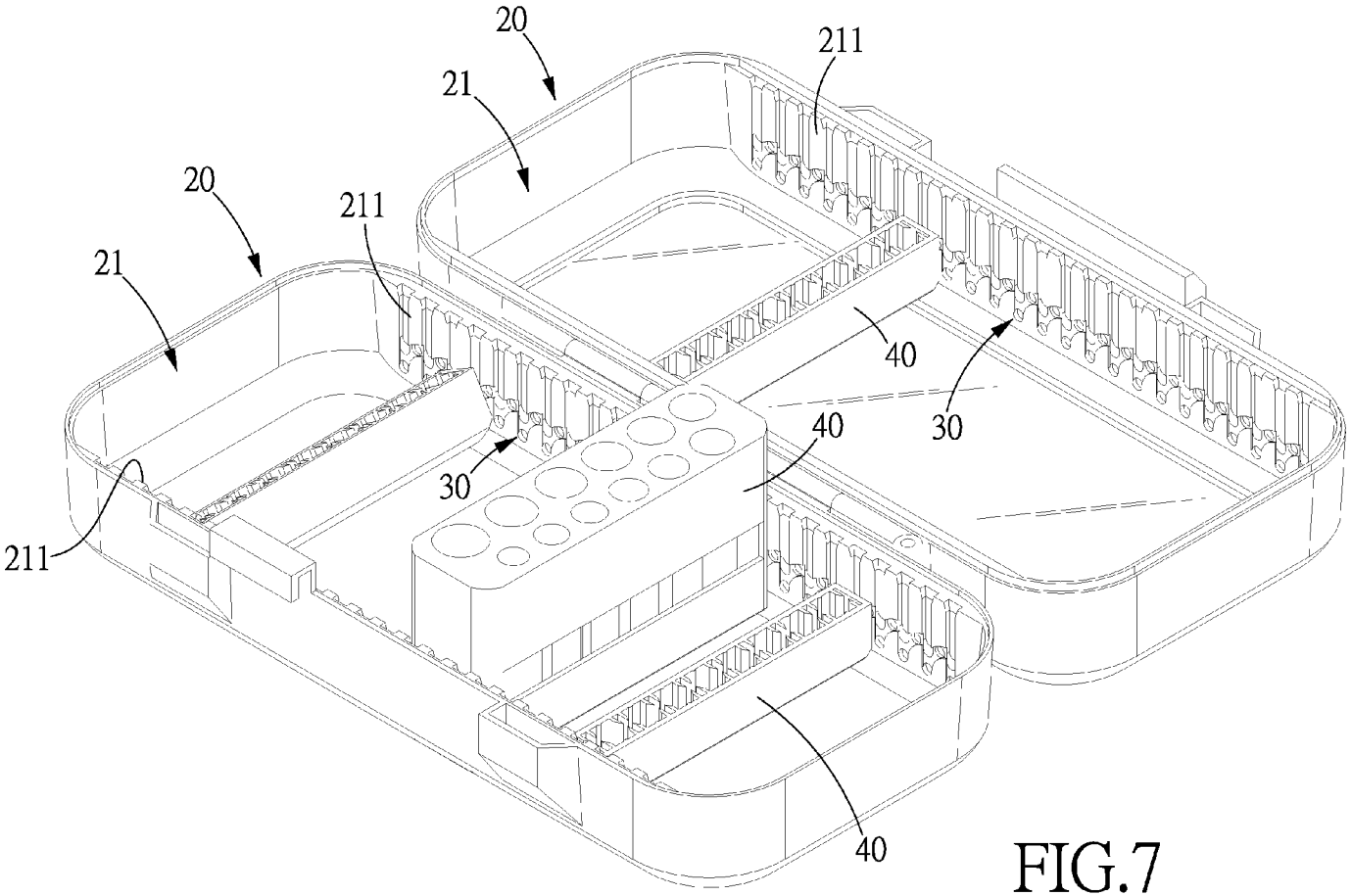
FIG. 7 is a perspective view of a tool box in accordance with a second embodiment of the present invention.

FIG. 7 shows another embodiment of the present invention, wherein both of the halves 20 of the tool box are provided with a chamber 21, and the positioning units 30 are positioned between the two walls 212 of each of the halves 20, so as to improve the storage capacity of the tool box.

While we have shown and described various embodiments in accordance with the present invention, it is clear to those skilled in the art that further embodiments may be made without departing from the scope of the present invention.

What is claimed is:

1. A tool box with storage members comprising:

two halves pivoted to each other to form the tool box and capable of being opened and closed with respect to each other, at least one of the two halves being formed with a chamber which includes a bottom and two opposite walls;

a plurality of positioning units disposed on the two walls, and each including a straight guide groove which is formed in the walls and located in a first direction, a guide gap which is formed at one end of the straight guide groove and located in the first direction, a positioning cavity which is formed at another end of the straight guide groove, disposed in the first direction and located closer to the bottom than the guide gap, a first pivot cavity which is formed in the walls, disposed in the first direction and located closer to the bottom than the positioning cavity, a second pivot cavity which is formed in the walls and located between the positioning cavity and a positioning cavity of a neighboring positioning unit, and an arc-shaped guide groove which is formed in the walls and covers the first and second pivot cavities, the arc-shaped guide groove including a first arc-shaped end at which the first pivot cavity is located, and a second arc-shaped end which is in communication with a straight guide groove of the neighboring positioning unit; and at least one said storage member removably and pivotally disposed in the chamber, and including at least one tool-insertion cavity and two lateral surfaces located toward the two walls, each of the lateral surfaces including a first pivot which is pivotally disposed in the first pivot cavity, and a second pivot which is pivotally disposed in the positioning cavity, or in the first or second pivot cavity of the neighboring positioning unit;

wherein the straight guide grooves which are formed in the walls of the tool box are in parallel to one another and perpendicular to the bottom of the chamber of the tool box.

2. The tool box with storage members as claimed in claim 1, wherein the positioning cavity of the straight guide groove is provided with an inclined guide surface which is located within the arc-shaped guide groove.

3. The tool box with storage members as claimed in claim 1, wherein distances from the first pivot cavity to the positioning cavity, to the first pivot cavity of the neighboring positioning unit, and to the second pivot cavity of the neighboring positioning unit, are the same.

* * * * *